US008495850B1

(12) United States Patent
Lin

(10) Patent No.: US 8,495,850 B1
(45) Date of Patent: Jul. 30, 2013

(54) BUILDING BLOCK ASSEMBLY

(76) Inventor: Chia-Yen Lin, Dongguan (CN)

( * ) Notice: Subject to any disclaimer, the term of this patent is extended or adjusted under 35 U.S.C. 154(b) by 0 days.

(21) Appl. No.: 13/411,707

(22) Filed: Mar. 5, 2012

(51) Int. Cl.
*E04B 2/00* (2006.01)

(52) U.S. Cl.
USPC ..... 52/592.6; 52/592.5; 52/588.1; 446/124; 446/125

(58) Field of Classification Search
USPC ... 52/592.5, 592.6, 596, 588.1, 604; 446/120, 446/124, 125
See application file for complete search history.

(56) References Cited

U.S. PATENT DOCUMENTS

| | | | | |
|---|---|---|---|---|
| 3,566,531 | A * | 3/1971 | Hasel et al. | 446/120 |
| 3,570,170 | A * | 3/1971 | Kishi | 446/128 |
| 3,962,817 | A | 6/1976 | Vullierme | |
| 4,964,833 | A * | 10/1990 | Suzuki | 446/118 |
| 5,057,049 | A * | 10/1991 | Kaczperski | 446/128 |
| 5,238,438 | A * | 8/1993 | Glickman | 446/126 |
| 5,538,452 | A * | 7/1996 | Kurani | 446/102 |
| 5,795,210 | A * | 8/1998 | Kushner et al. | 446/128 |
| 5,853,314 | A * | 12/1998 | Bora | 446/120 |
| 5,993,282 | A * | 11/1999 | Ernst | 446/124 |
| 6,050,044 | A * | 4/2000 | McIntosh | 52/591.1 |
| 6,086,444 | A * | 7/2000 | Glickman | 446/124 |
| 6,315,628 | B1 * | 11/2001 | Quercetti | 446/128 |
| 6,511,073 | B2 * | 1/2003 | Simonds | 273/299 |
| 6,554,676 | B1 * | 4/2003 | Bach | 446/116 |
| 6,645,033 | B1 * | 11/2003 | Thomsen | 446/120 |
| 6,648,715 | B2 * | 11/2003 | Wiens et al. | 446/121 |
| 6,682,385 | B2 * | 1/2004 | Atzen et al. | 446/124 |
| 6,736,691 | B1 * | 5/2004 | Bach | 446/128 |
| 6,899,588 | B1 * | 5/2005 | Clever et al. | 446/120 |
| 7,198,537 | B1 * | 4/2007 | Clever et al. | 446/120 |
| 7,267,598 | B2 * | 9/2007 | Glickman | 446/124 |
| 2003/0129918 | A1 * | 7/2003 | Atzen et al. | 446/124 |
| 2004/0159068 | A1 * | 8/2004 | Prokofyev | 52/606 |
| 2006/0150376 | A1 * | 7/2006 | Chen | 24/615 |
| 2008/0216436 | A1 * | 9/2008 | Rodriguez Carassus | 52/588.1 |
| 2010/0203796 | A1 * | 8/2010 | Beg | 446/120 |
| 2010/0210173 | A1 * | 8/2010 | Maggiore et al. | 446/125 |

FOREIGN PATENT DOCUMENTS

| | | | |
|---|---|---|---|
| CN | 2320300 | Y | 5/1999 |
| CN | 2455323 | Y | 10/2001 |
| CN | 102553262 | A | 7/2012 |

OTHER PUBLICATIONS

PCTCN2011084881 International Search Report.

* cited by examiner

*Primary Examiner* — Basil Katcheves
*Assistant Examiner* — Joshua Ihezie

(57) ABSTRACT

A two-piece building block assembly includes a hollow block and an inner piece. The hollow block has a plurality of studs extending from a top thereof, an opening defined in an underside thereof and a plurality of ribs extends from side walls thereof. The inner piece is corresponding to and received in the opening of the hollow block. A plurality of recesses is defined in the periphery of the inner piece and located corresponding to the studs. The inner piece includes support boards. Each support board is defined between the adjacent recesses and disposed between the two adjacent ribs that are located on the same side wall of the hollow block. The inner piece reinforces the opening of the hollow block to prevent the opening from being deformed. Thus, the building block assembly does not have to be made of high-stiffness or high-density materials.

8 Claims, 9 Drawing Sheets

BUILDING BLOCK ASSEMBLY

BACKGROUND OF THE INVENTION

1. Field of the Invention

The present invention relates to a building block assembly, and in particular to a two-piece building block assembly which does not need to be made of high-stiffness materials or high-density materials.

2. The Prior Arts

The building block is an educational, developmental and creative toy that nurtures imagination. The player assembles building blocks to construct various objects in various shapes and structures. The manufacturers keep launching new building blocks into the market to allow the players to build with more and more different combinations. Therefore, the building blocks are one of the most popular toys in the market.

In order to reduce the manufacturing cost, conventional building blocks are made to be hollow bricks. Referring to FIGS. 9 and 10, a conventional hollow block 70 includes a plurality of studs 71 disposed on a top thereof and an opening defined in a bottom thereof. A hollow fixing member 72 is disposed in the block 70, and extends from an underside of the top to the opening. A plurality of ribs 73 extend from the insides of the block 70 so that a plurality of paths 74 are defined between the ribs 73 and the fixing member 72. When assembling the blocks 70, the studs 71 of one block 70 are inserted into the opening of another block 70 and are engaged with the paths 74. The fixing member 72 and the ribs 73 hold the studs 71 therebetween so that the studs 71 are secured in the paths 74.

Since the studs 71 are tightly fitted in the paths 74, the opening of the block 70 would likely to be squeezed and deformed after repeated assembling and disassembling of the blocks 70. In order to prevent the assembling of the blocks 70 form getting loose due to deformation, the thickness of the walls of the bocks 70 is increased and the blocks 70 are made of a stiff material or a material having high density, such as ABS plastic. Therefore, the materials, which are suitable to manufacturing the building blocks, are limited and expensive. The additional costs would be transferred to customers.

SUMMARY OF THE INVENTION

A primary objective of the present invention is to provide a building block that overcomes the disadvantages of conventional building blocks that need to be made of stiff materials or high-density materials.

Another objective of the present invention is to provide a building block that could keep the strength of the block and prevent an opening of the block from being deformed while the block is not made of stiff materials or high-density materials.

In order to achieve the objectives mentioned above, a building block according to the present invention has two pieces connected with each other. The two-piece building block assembly according to the present invention includes a hollow block and an inner piece. The hollow block has a plurality of studs extending from a top thereof, an opening defined in an underside thereof and a plurality of ribs extend from inner surfaces of side walls thereof. The inner piece is shaped to be received in the opening of the hollow block. A plurality of recesses is defined in the periphery of the inner piece and located corresponding to the studs. A plurality of support boards are defined between the adjacent recesses. Each support board is disposed between the two adjacent ribs that are disposed on the same side wall of the hollow block. When the hollow block connects with the inner piece, the ribs of the hollow block are disposed corresponding to the recesses of the inner piece.

According to the present invention, the inner piece is received in the opening of the hollow block so as to reinforce the structure of the opening. Therefore, the opening would not be deformed by squeezing. The inner piece includes recesses which are located corresponding to the studs of the hollow block. Thus, when assembling the building block assemblies, the studs of one building block assembly are engaged with the recesses of another building block assembly. By this way, the building block assemblies do not need to be made of stiff materials or high-density materials while the strength of the opening is maintained. The thickness of the building block assembly may also be reduced. The manufacturing cost for the building block assemblies is reduced. The manufactures can select low cost materials, or high bio-degradable materials or low pollution materials to protect the environment.

BRIEF DESCRIPTION OF THE DRAWINGS

The present invention will be apparent to those skilled in the art by reading the following detailed description of preferred embodiments thereof, with reference to the attached drawings, in which.

DETAILED DESCRIPTION OF THE PREFERRED EMBODIMENT

Figure 1:
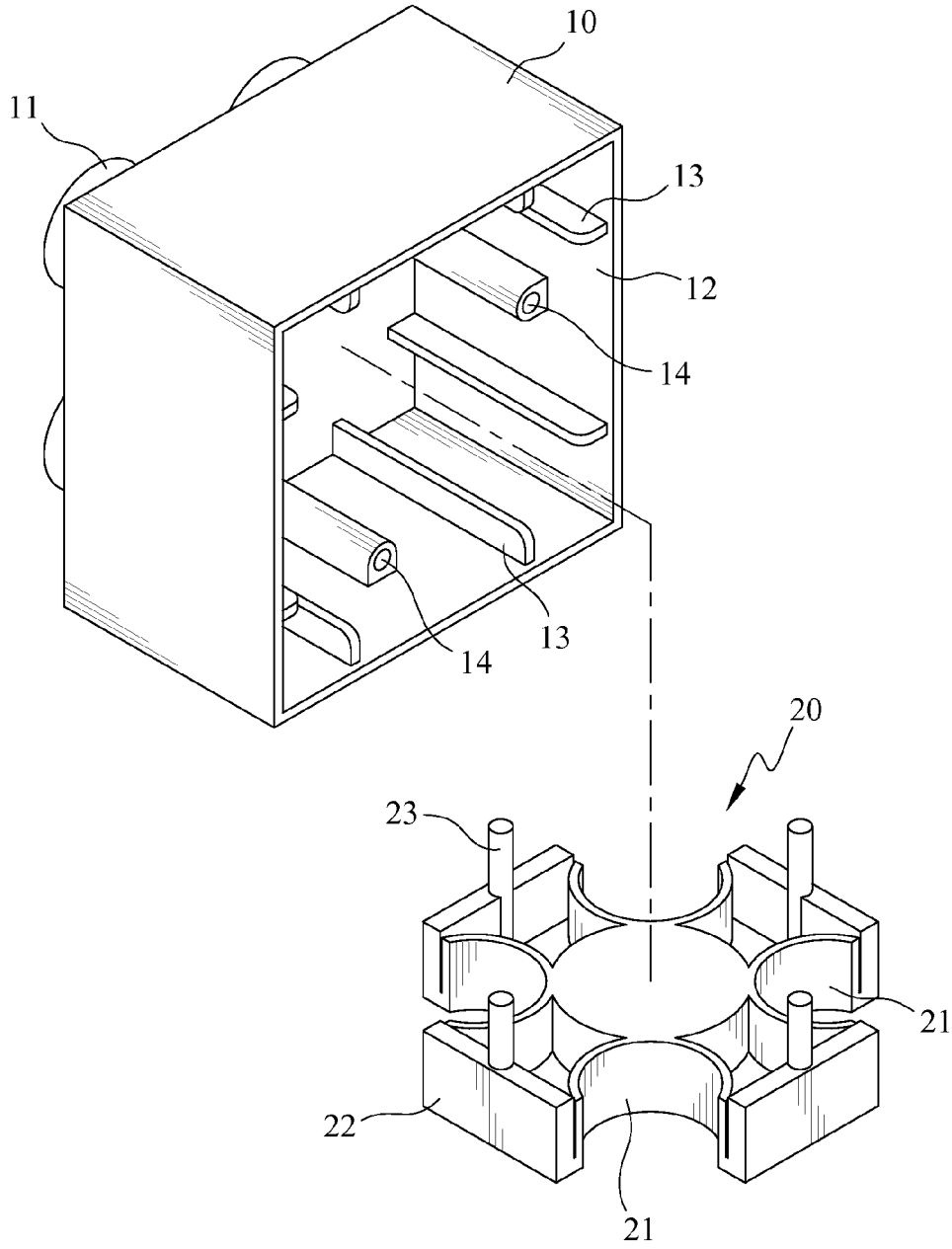
FIG. 1 is an exploded view showing a building block assembly according to the present invention.
Figure 2:
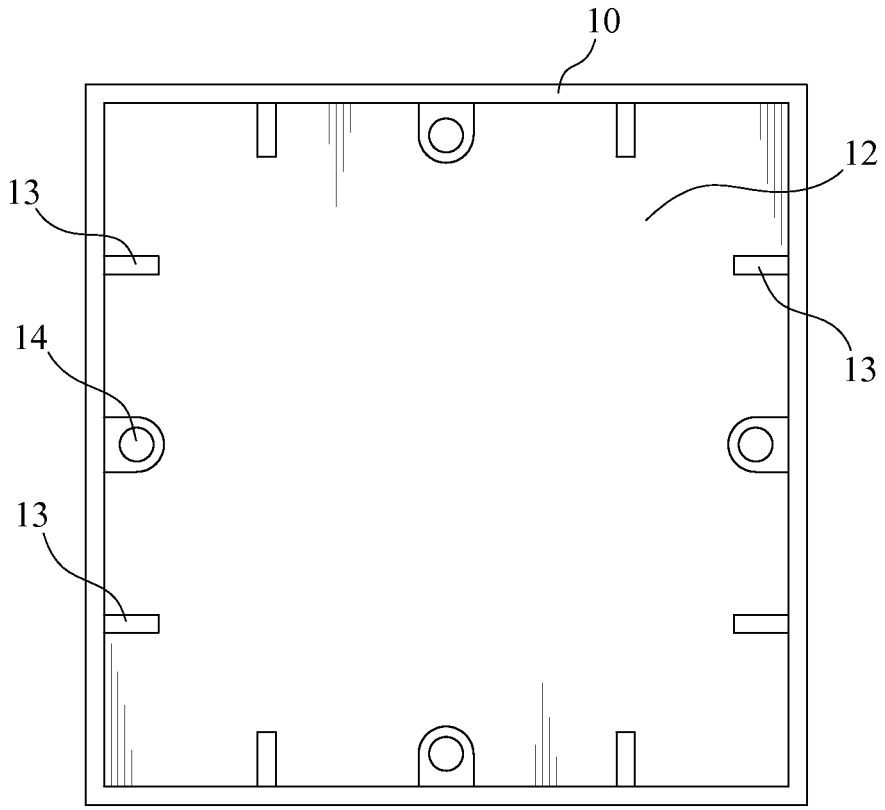
FIG. 2 is a bottom view showing a hollow block of the building block assembly according to the present invention.
Figure 3:
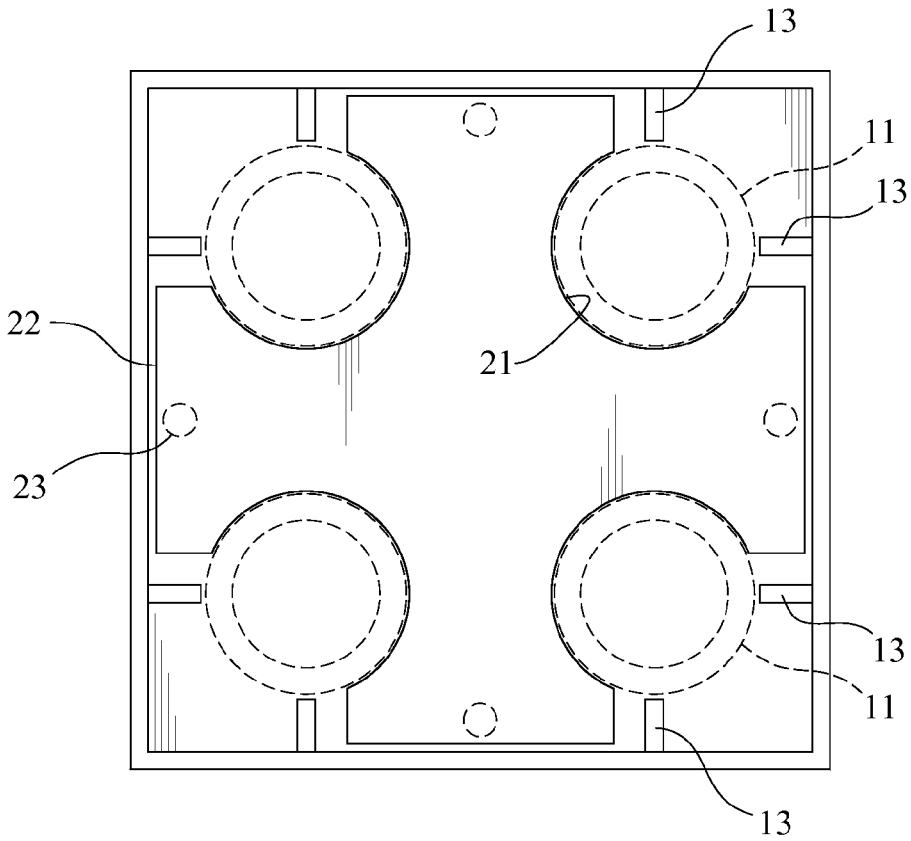
FIG. 3 is a bottom view showing the building block assembly according to the present invention.

Referring to FIGS. 1 to 3, a two-piece building block assembly according to a first embodiment of the present invention comprises a hollow block 10 and an inner piece 20 corresponding to the hollow block 10. The hollow block 10 includes a plurality of studs 11 extending from a top thereof, an opening 12 defined in an underside thereof and a plurality of ribs 13. The ribs 13 are extended from inner surfaces of side walls of the hollow block 10.

As shown in FIGS. 1 and 3, the inner piece 20 is shaped to be corresponding to the opening 12 of the hollow block 10 and is fitted into the opening 12. The inner piece 20 includes a plurality of recesses 21 defined in the periphery thereof. The shapes, sizes and the positions of the recesses 21 are corresponding to those of the studs 11. The ribs 13 of the hollow block 10 are located corresponding to the studs 11 and the recesses 21. Therefore, when the studs 11 of the hollow block 10 are inserted into the recesses 21 of the inner piece 20, each of the studs 11 is securely held by the corresponding rib 13 and recess 21. Moreover, the inner piece 20 includes a plurality of support boards 22. Each support board 22 is defined between the two adjacent recesses 21. When the hollow block 10 is engaged with the inner piece 20, each support board 22 is disposed between the two adjacent ribs 13 that are located on the same side wall of the hollow block 10.

The hollow block 10 may further include a plurality of connection holes 14 defined in the inner surfaces of the side walls of the hollow block 10 and each connection hole 14 is disposed between two adjacent ribs 13. Each support board 22 may have an insertion rod 23 corresponding to the connection hole 14. When the inner piece 20 is engaged with the hollow block 10, the insertion rods 23 are fitted into the connection holes 14 for securely connecting the hollow block 10 with the inner piece 20.

Figure 4:
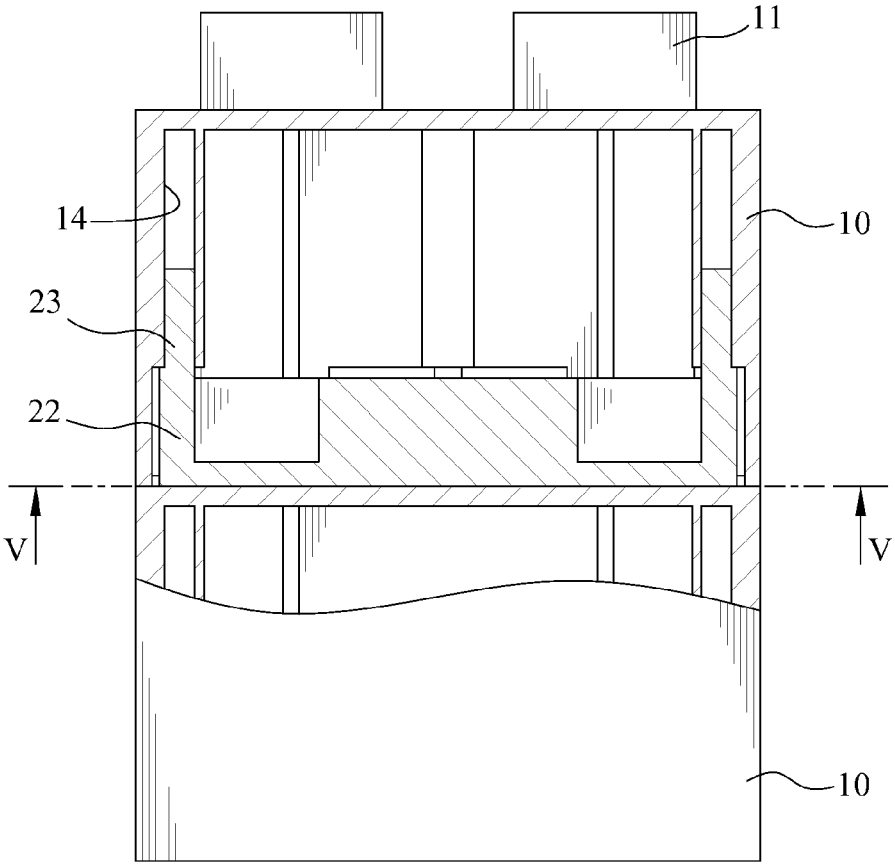
FIG. 4 is a cross sectional view showing the connected building block assemblies according to the present invention.
Figure 5:
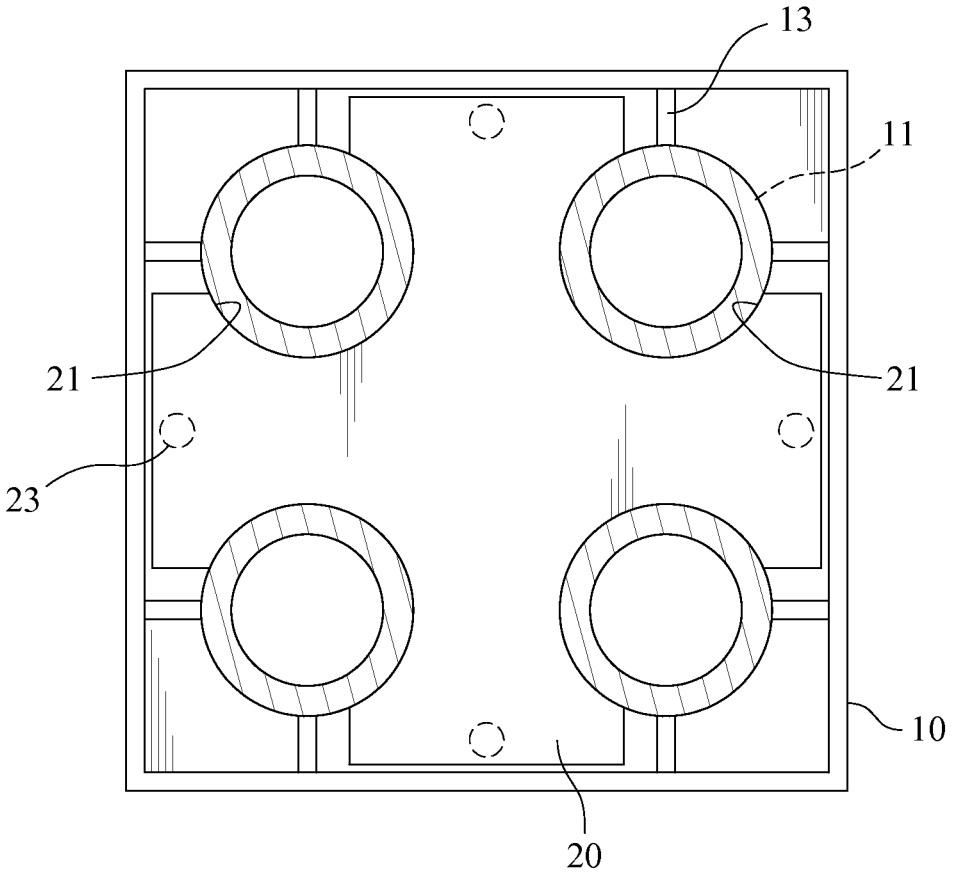
FIG. 5 is a cross sectional view taken along line V-V in FIG. 4.

Referring to FIGS. 4 and 5, when assembling the building block assemblies, the studs 11 of one building block assembly are inserted into the recesses 21 of another building block assembly, the recesses 21 and the ribs 13 respectively contact with the corresponding studs 11 to form multiple contact points. By this way, the studs 11 are securely fitted in the recesses 21.

According to the present invention, the inner piece 20 is received in the opening 12 of the hollow block 10 and the support boards 22 support the side walls of the opening 12 of the hollow block 10. Therefore, even if the hollow block 10 is squeezed by external forces, the support boards 22 of the inner piece 20 prevent the opening 12 from being deformed. Moreover, the inner piece 20 has multiple recesses 21 that are able to connect with studs 11 of other building block assemblies, thereby assembling multiple building block assemblies together.

Figure 6:
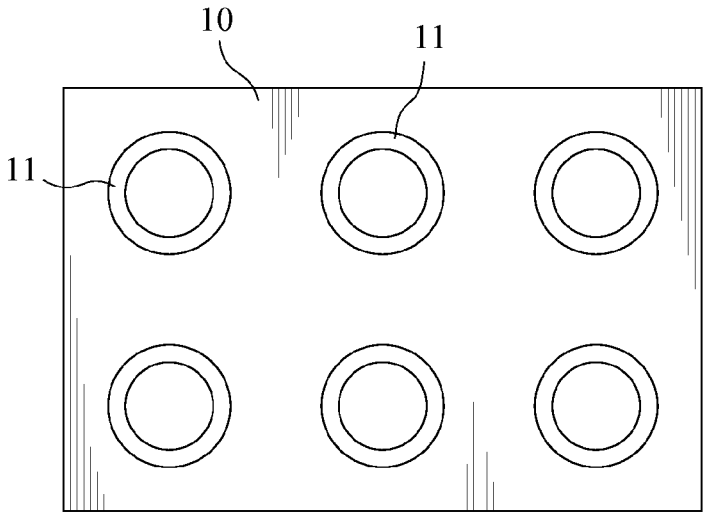
FIG. 6 is a top view showing a building block assembly according to a second embodiment of the present invention.
Figure 7:
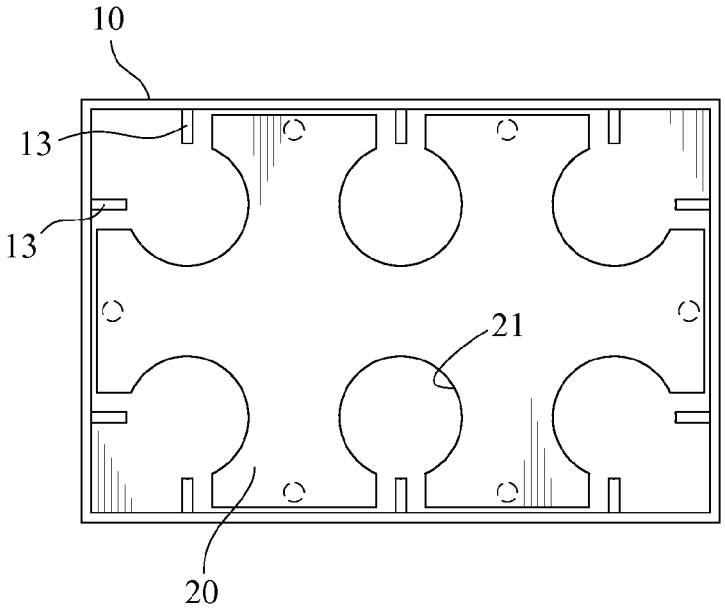
FIG. 7 is a bottom view showing the building block assembly according to the second embodiment of the present invention.

The building block assembly according to the first embodiment has a square cross section. The hollow block 10 has four studs 11 disposed on the top thereof and the inner piece 20 has four recesses 21. The building block assembly may have other shapes, and the numbers of the studs 11 and the recesses 21 may be changed. As shown in FIGS. 6 and 7, the building block assembly according to a second embodiment has a rectangular cross section. The hollow block 10 has six studs 11 disposed on the top thereof and the inner piece 20 has six recesses 21.

Figure 8:
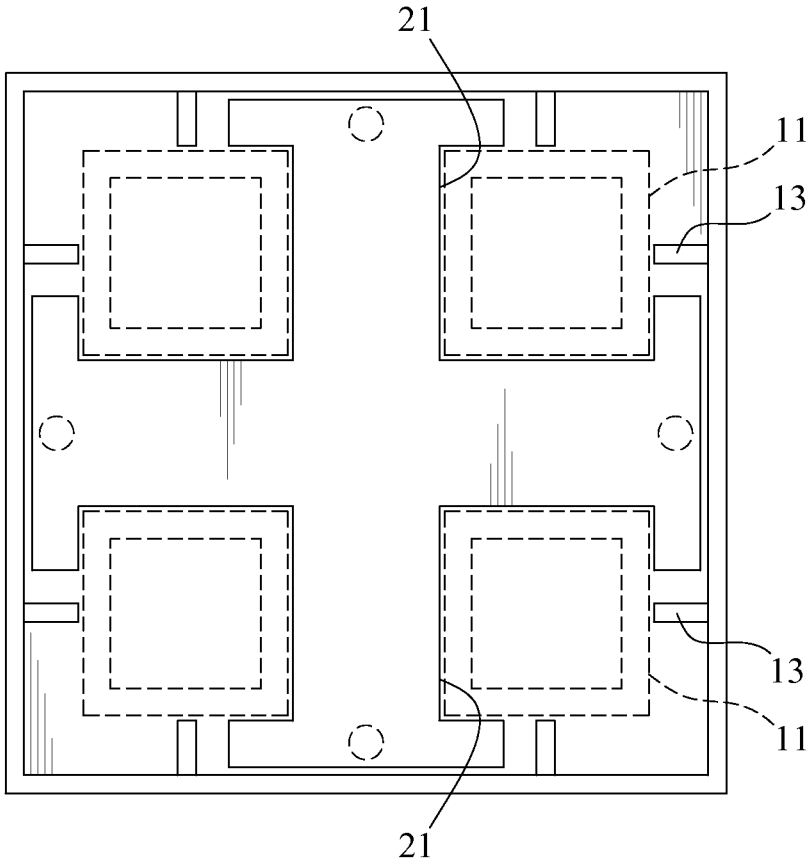
FIG. 8 is a bottom view showing a building block assembly according to a third embodiment of the present invention.
Figure 9:
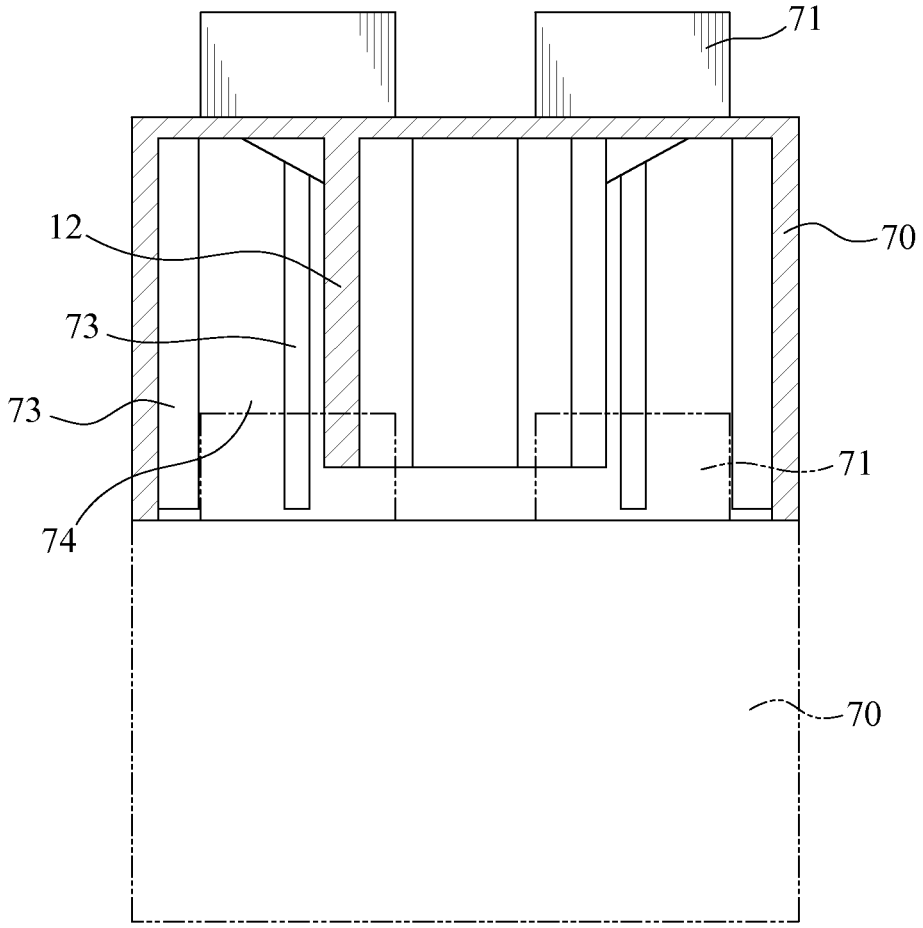
FIG. 9 ( Prior Art )
FIG. 9 shows a conventional building block assembly.
Figure 10:
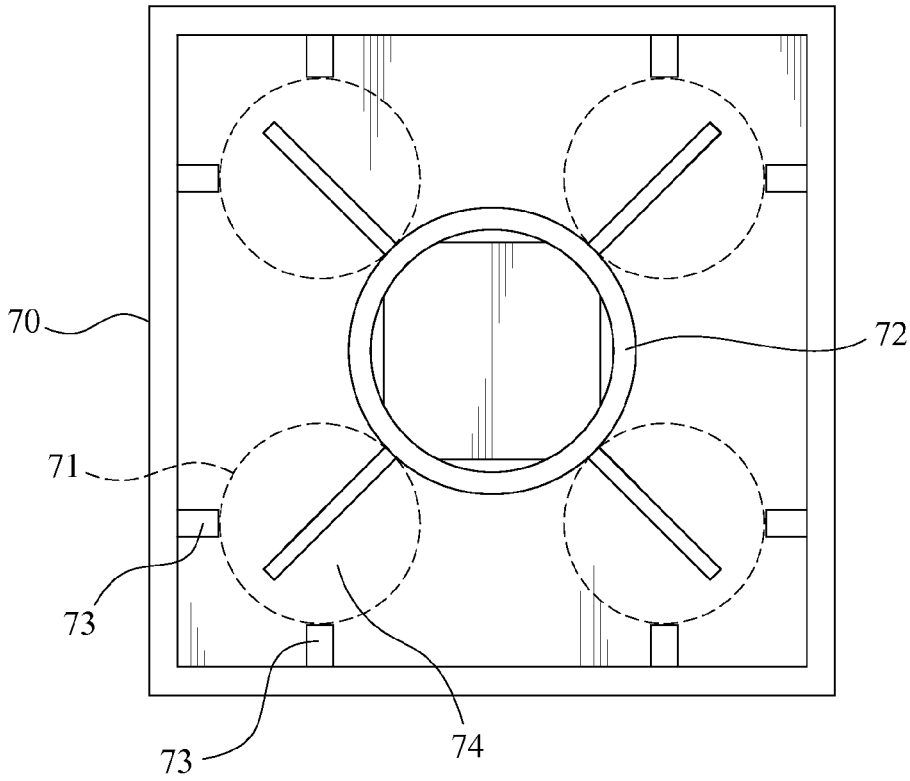
FIG. 10 ( Prior Art )
FIG. 10 is a bottom view showing the conventional building block assembly.

According to the first and second embodiments, the studs 11 of the two-piece building block assembly are circular rods and the recesses 21 are circular recesses. According to a third embodiment, the studs 11 are square rods and the recesses 21 are square recesses, as shown in FIG. 8.

The characteristic of the present invention is that the building block assembly has two pieces. An inner piece 20 is received within the opening 12 of the hollow block 10 and the support boards 22 support the side walls of the opening 12 so as to prevent the opening 12 from being deformed by exterior forces. Because the hollow block 10 and the inner piece 20 enhance the strength of the opening 12, the material of the building block assembly according to the present invention is not limited to materials having high stiffness or high density. Thus, there is a wide selection range of materials. The manufactures can select cheap materials to reduce the manufacturing cost or select materials considering eco-friendly issues, such as bio-degradability or low-pollution.

Although the present invention has been described with reference to the preferred embodiments thereof, it is apparent to those skilled in the art that a variety of modifications and changes may be made without departing from the scope of the present invention which is intended to be defined by the appended claims.

What is claimed is:

1. A building block assembly, comprising:

a hollow block including a plurality of studs extending from a top thereof, an opening defined in an underside thereof; and an inner piece corresponding to and fully received inside the hollow block through the opening of the hollow block, the inner piece including a plurality of recesses defined in a periphery of the inner piece and corresponding to the studs, the inner piece including a plurality of support boards, each support board defined between the adjacent recesses;

wherein the hollow block further includes a plurality of ribs extended from side walls thereof and respectively located corresponding to the recesses of the inner piece, each support board is held inside the hollow block between two adjacent ribs that are located on the same side wall of the hollow block when the hollow block is connected with the inner piece.

2. The building block assembly as claimed in claim 1, wherein the hollow block comprises a plurality of connection holes defined in the side walls thereof, each connection hole is disposed between two adjacent ribs, each support board has an insertion rod corresponding to the connection hole, and the insertion rods are inserted into the connection holes when the inner piece is engaged with the hollow block.

3. The building block assembly as claimed in claim 1, wherein the hollow block has a square cross section and comprises four studs disposed on the top thereof, and the inner piece comprises four recesses.

4. The building block assembly as claimed in claim 3, wherein the studs are circular studs and the recesses are circular recesses.

5. The building block assembly as claimed in claim 3, wherein the studs are rectangular studs and the recesses are rectangular recesses.

6. The building block assembly as claimed in claim 1, wherein the hollow block has a rectangular cross section and comprises six studs disposed on the top thereof, and the inner piece comprises six recesses.

7. The building block assembly as claimed in claim 6, wherein the studs are circular studs and the recesses are circular recesses.

8. The building block assembly as claimed in claim 6, wherein the studs are rectangular studs and the recesses are rectangular recesses.

* * * * *